US010889114B2

(12) United States Patent
Okazawa et al.

(10) Patent No.: US 10,889,114 B2
(45) Date of Patent: Jan. 12, 2021

(54) LIQUID EJECTING APPARATUS AND LIQUID EJECTING HEAD

(71) Applicant: Seiko Epson Corporation, Tokyo (JP)

(72) Inventors: Noriaki Okazawa, Shiojiri (JP); Toshiki Usui, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/516,441

(22) Filed: Jul. 19, 2019

(65) Prior Publication Data

US 2020/0023643 A1 Jan. 23, 2020

(30) Foreign Application Priority Data

Jul. 20, 2018 (JP) ..... 2018-137108

(51) Int. Cl.
*B41J 2/14* (2006.01)

(52) U.S. Cl.
CPC .. *B41J 2/14209* (2013.01); *B41J 2002/14491* (2013.01)

(58) Field of Classification Search
CPC ..... B41J 2/14209; B41J 2/14233
See application file for complete search history.

(56) References Cited

U.S. PATENT DOCUMENTS

2005/0104936 A1* 5/2005 Conta ..... B41J 2/1603 347/65
2009/0273653 A1* 11/2009 Hirano ..... B41J 2/161 347/71
2011/0254900 A1* 10/2011 Kang ..... B41J 2/1629 347/71
2017/0144438 A1* 5/2017 Hayakawa ..... B81B 7/0006

FOREIGN PATENT DOCUMENTS

JP 2012-183669 A 9/2012

* cited by examiner

*Primary Examiner* — Jason S Uhlenhake
(74) *Attorney, Agent, or Firm* — Harness, Dickey & Pierce, P.L.C.

(57) ABSTRACT

A liquid ejecting apparatus includes a liquid ejecting unit including at least one pressure chamber filled with a reactive ink, at least one nozzle communicating with the pressure chamber, a supply channel through which the reactive ink is supplied to the pressure chamber, and an elastic compliance film forming a portion of the supply channel; a piezoelectric element that changes a capacity of the pressure chamber when an electric signal is supplied to the piezoelectric element; and a flexible wiring substrate at which a signal wire for supplying the electric signal to a connection terminal of the piezoelectric element is formed. The elastic compliance film is formed of a para-aramid resin. The connection terminal and the signal wire are electrically connected to each other by solder.

13 Claims, 7 Drawing Sheets

FIG. 4

| No. | MATERIAL | MODULUS OF ELASTICITY | HEAT RESISTANCE | SOLVENT INK | PHOTOREACTIVE INK | TEXTILE PRINTING INK | PRETREATMENT INK |
|---|---|---|---|---|---|---|---|
| A1 | PARA-ARAMID RESIN FILM | ◎ | ○ | ◎ | ○ | ○ | ○ |
| A2 | ULTRAHIGH-MOLECULAR-WEIGHT-POLYETHYLENE-BASED FILM | ○ | ○ | × | △ | × | ○ |
| A3 | POLYARYLATE-BASED FILM | ○ | ○ | × | ○ | △ | △ |
| A4 | PBO-BASED FILM | ○ | ○ | △ | × | × | △ |
| A5 | CARBON-BASED FILM | ○ | ○ | ○ | △ | × | ○ |
| A6 | POLYPHENYLENE-SULFIDE-BASED FILM | ○ | ◎ | ○ | × | × | △ |
| A7 | POLYIMIDE-BASED FILM | ○ | ○ | × | × | ○ | ○ |

× : FAILURE OCCURS WITHIN 1 MONTH

△ : FAILURE OCCURS WITHIN 6 MONTHS

○ : FAILURE OCCURS WITHIN 1 YEAR

◎ : STABLE OPERATION FOR 1 YEAR OR MORE

FIG. 6

| No. | MATERIAL | SOLVENT INK | PHOTOREACTIVE INK | TEXTILE PRINTING INK | PRETREATMENT INK |
|---|---|---|---|---|---|
| B1 | TB3303G | × | ○ | △ | △ |
| B2 | SX-ECA48 | △ | △ | × | × |
| B3 | Sn-Pb-BASED SOLDER | ◎ | ◎ | ◎ | ◎ |
| B4 | Sn-Zn-BASED SOLDER | ○ | ○ | ○ | ○ |
| B5 | Sn-Cu-BASED SOLDER | ◎ | ◎ | ◎ | ◎ |
| B6 | Sn-Ag-BASED SOLDER | ◎ | ◎ | ◎ | ◎ |

× : FAILURE OCCURS WITHIN 1 MONTH

△ : FAILURE OCCURS WITHIN 6 MONTHS

○ : FAILURE OCCURS WITHIN 1 YEAR

◎ : STABLE OPERATION FOR 1 YEAR OR MORE

LIQUID EJECTING APPARATUS AND LIQUID EJECTING HEAD

The present application is based on, and claims priority from, JP Application Serial Number 2018-137108, filed Jul. 20, 2018, the disclosure of which is hereby incorporated by reference herein in its entirety.

BACKGROUND

1. Technical Field

The present disclosure relates to a liquid ejecting apparatus and a liquid ejecting head.

2. Related Art

A liquid ejecting head that ejects an ink in a pressure chamber from a nozzle by changing the capacity of the pressure chamber by a piezoelectric element has been proposed. Since there is no need to heat an ink in a configuration using a piezoelectric element, various types of inks can be used. Specifically, various reactive inks such as a solvent ink containing an organic solvent are used as well as a water-based ink and an oil-based ink.

A reactive ink tends to be highly aggressive to other members formed of an organic material or the like. JP-A-2012-183669 discloses an improvement in an adhesive used for a liquid ejecting head that ejects an ink having high aggressiveness.

However, the reactive ink may affect elements other than the adhesive, for example, a member constituting a channel or a connection portion between terminals. With the configuration that ejects a very small amount of an ink, since an atomized ink electrically charged by the Lenard effect adheres to a wire, a problem in the case of using the reactive ink is particularly significant. In view of the above-described circumstances, even when the adhesive is improved by the technique disclosed in JP-A-2012-183669, various failures due to the reactive ink cannot be sufficiently addressed.

SUMMARY

To address the above-described problem, a liquid ejecting apparatus according to a desirable aspect of the present disclosure includes a liquid ejecting unit including at least one pressure chamber filled with a reactive ink, at least one nozzle communicating with the pressure chamber, a supply channel through which the reactive ink is supplied to the pressure chamber, and an elastic compliance film forming a portion of the supply channel; a piezoelectric element that changes a capacity of the pressure chamber when an electric signal is supplied to the piezoelectric element; and a flexible wiring substrate at which a signal wire for supplying the electric signal to a connection terminal of the piezoelectric element is formed. The elastic compliance film is formed of a para-aramid resin. The connection terminal and the signal wire are electrically connected to each other by solder.

A liquid ejecting head according to another desirable aspect of the present disclosure includes a liquid ejecting unit including at least one pressure chamber filled with a reactive ink, at least one nozzle communicating with the pressure chamber, a supply channel through which the reactive ink is supplied to the pressure chamber, and an elastic compliance film forming a portion of the supply channel; a piezoelectric element that changes a capacity of the pressure chamber when an electric signal is supplied to the piezoelectric element; and a flexible wiring substrate at which a signal wire for supplying the electric signal to a connection terminal of the piezoelectric element is formed. The elastic compliance film is formed of a para-aramid resin. The connection terminal and the signal wire are electrically connected to each other by solder.

BRIEF DESCRIPTION OF THE DRAWINGS

FIG. 4 is a table illustrating the results of evaluation on the occurrence of a failure in the liquid ejecting head in a plurality of cases using mutually different combinations of materials of elastic compliance films and types of reactive inks.

FIG. 6 is a table illustrating the results of evaluation on the occurrence of a failure in the liquid ejecting head in a plurality of cases using mutually different combinations of materials for electrically connecting a signal wire and a connection terminal, and types of reactive inks.

DESCRIPTION OF EXEMPLARY EMBODIMENTS

First Embodiment

Figure 1:
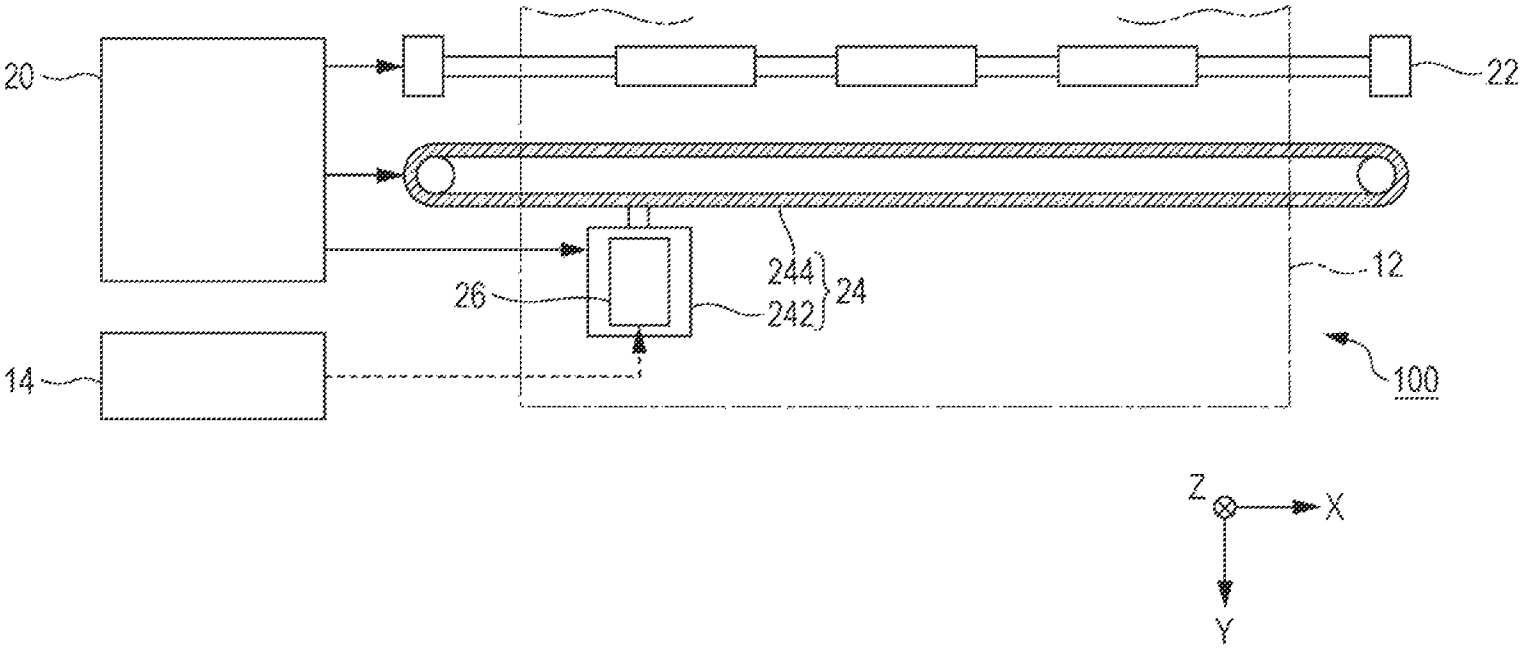
FIG. 1 is a configuration diagram of a liquid ejecting apparatus according to a first embodiment of the present disclosure.

FIG. 1 is a configuration diagram of a liquid ejecting apparatus 100 according to a first embodiment of the present disclosure. The liquid ejecting apparatus 100 according to the first embodiment is an ink jet printing apparatus that ejects an ink, which is an example of a liquid, onto a medium 12. The medium 12 is typically a printing sheet of paper; however, a printing object of any material, such as a resin film or a fabric, is used as the medium 12.

The liquid ejecting apparatus 100 according to the first embodiment ejects a reactive ink onto the medium 12. Typical examples of the reactive ink include a solvent ink in which a coloring material such as a pigment or a dye is dispersed in one of various solvents, such as an oil-based solvent or a water-based solvent; or a photoreactive ink whose characteristics are changed by irradiation with light. Examples of the photoreactive ink include an ultraviolet curable ink which is cured by irradiation with ultraviolet rays. A solvent ink is disclosed in, for example, JP-A-2014-80539, and a photoreactive ink is disclosed in, for example, JP-A-2015-174077. In addition to the solvent ink and the photoreactive ink exemplified above, a textile printing ink suitable for textile printing on a fabric or a pretreatment ink previously ejected to a fabric as a pretreatment of textile printing is also an example of the reactive ink. A textile printing ink is disclosed in, for example, JP-A-2017-222943, and a pretreatment ink is disclosed in JP-A-2004-143621. A reactive ink tends to be more aggressive to an organic material than a water-based ink.

As illustrated in FIG. 1, a liquid container 14 for storing the reactive ink is disposed in the liquid ejecting apparatus 100. For example, a cartridge attachable/detachable to/from the liquid ejecting apparatus 100, a bag-shaped ink pack formed of a flexible film, or an ink tank capable of refilled with the reactive ink may be used as the liquid container 14.

As illustrated in FIG. 1, the liquid ejecting apparatus 100 includes a control unit 20, a transport mechanism 22, a movement mechanism 24, and a liquid ejecting head 26. The control unit 20 includes, for example, a processing circuit, such as a central processing unit (CPU) or a field programmable gate array (FPGA), and a memory circuit such as a semiconductor memory. The control unit 20 centrally controls the elements of the liquid ejecting apparatus 100. The transport mechanism 22 transports the medium 12 in the Y direction under the control of the control unit 20.

The movement mechanism 24 reciprocates the liquid ejecting head 26 in the X direction under the control of the control unit 20. The X direction is a direction orthogonal to the Y direction in which the medium 12 is transported. The movement mechanism 24 according to the first embodiment includes a substantially box-shaped transport body 242 (carriage) that houses the liquid ejecting head 26, and a transport belt 244 to which the transport body 242 is fixed. Alternatively, a configuration in which a plurality of liquid ejecting heads 26 are mounted at the transport body 242 or a configuration in which the liquid container 14 is mounted at the transport body 242 together with the liquid ejecting head 26 may also be employed.

The liquid ejecting head 26 ejects the reactive ink supplied from the liquid container 14 onto the medium 12 from a plurality of nozzles (that is, ejection holes) under the control of the control unit 20. The liquid ejecting head 26 ejects the reactive ink onto the medium 12 in synchronization with the transport of the medium 12 by the transport mechanism 22 and the repetitive reciprocation of the transport body 242. Thus, a desirable image is formed on a surface of the medium 12.

Figure 2:
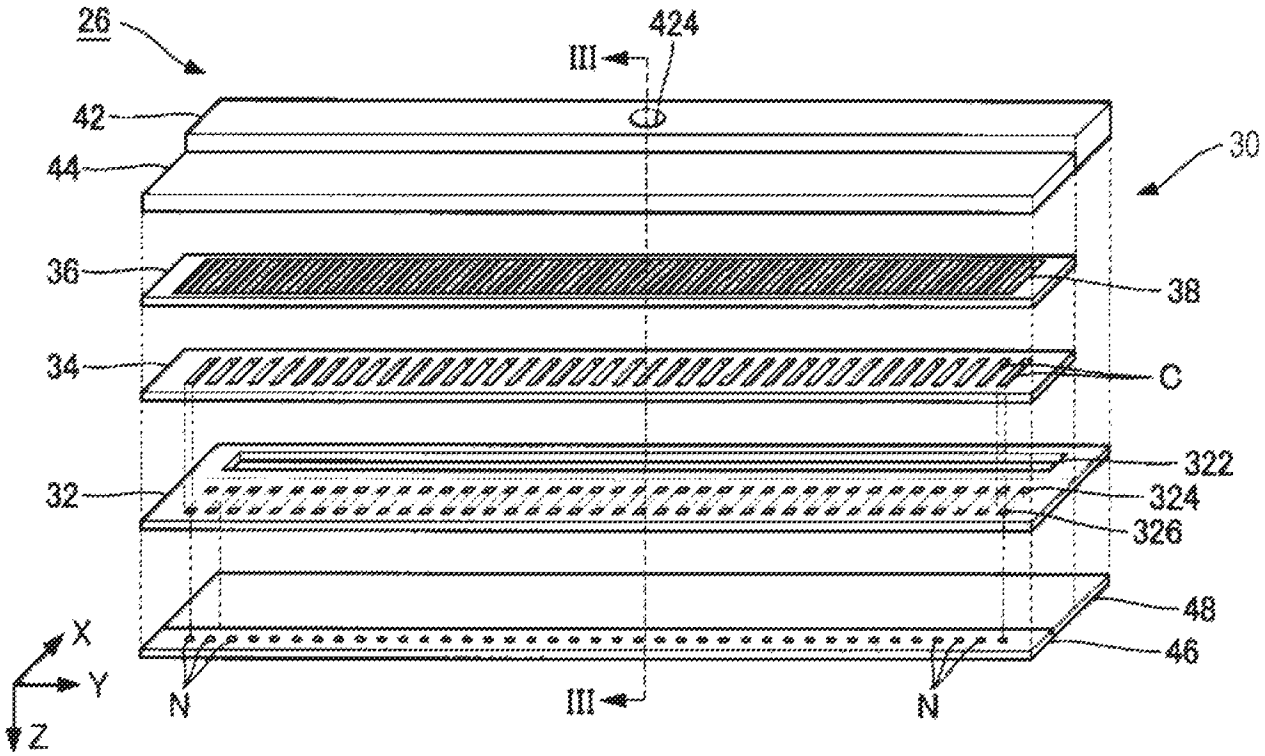
FIG. 2 is an exploded perspective view of a liquid ejecting head.
Figure 3:
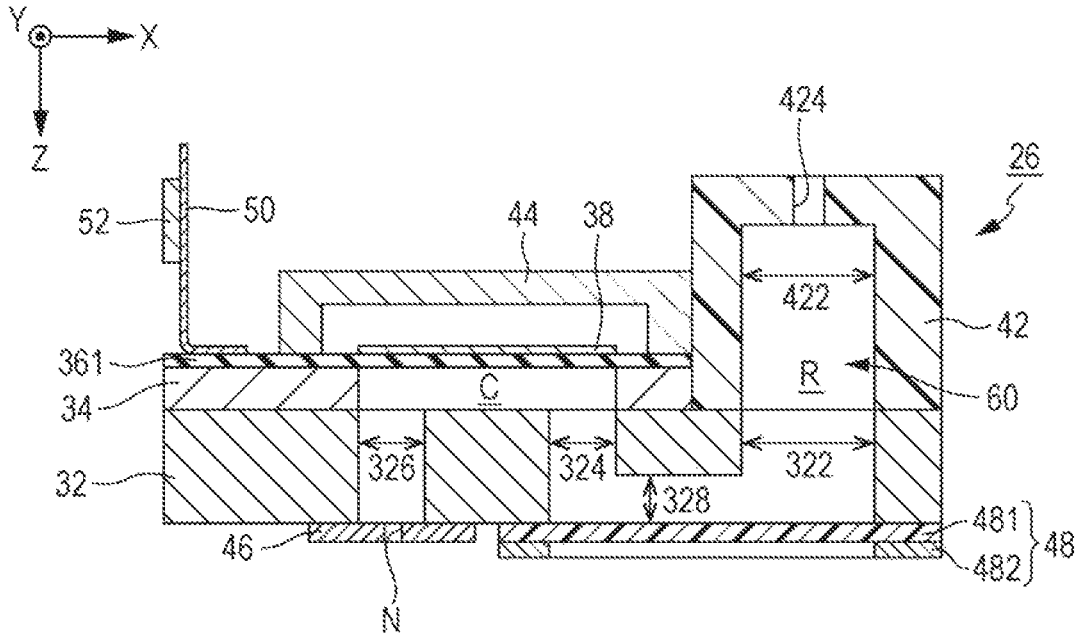
FIG. 3 is a cross-sectional view of the liquid ejecting head.

FIG. 2 is an exploded perspective view of the liquid ejecting head 26, and FIG. 3 is a cross-sectional view taken along line III-III in FIG. 2. As illustrated in FIG. 2, the direction perpendicular to the X-Y plane is hereinafter referred to as the Z direction. The ejection direction of the reactive ink by the liquid ejecting head 26 corresponds to the Z direction. The X-Y plane is, for example, a plane parallel to the surface of the medium 12, and the Z direction is, for example, the vertical direction.

As illustrated in FIGS. 2 and 3, the liquid ejecting head 26 includes a liquid ejecting unit 30, a plurality of piezoelectric elements 38, and a wiring substrate 50. In FIG. 2, the illustration of the wiring substrate 50 is omitted. The liquid ejecting unit 30 is a structure that forms a channel through which the reactive ink flows. Each of the plurality of piezoelectric elements 38 is a driving element for ejecting the reactive ink from a nozzle. The wiring substrate 50 transmits electric signals (hereinafter referred to as "drive signals") for driving the plurality of piezoelectric elements 38.

As illustrated in FIGS. 2 and 3, the liquid ejecting unit 30 includes a channel substrate 32, a pressure chamber substrate 34, a vibrating plate 36, a housing 42, a sealing body 44, a nozzle plate 46, and a vibration absorber 48. The pressure chamber substrate 34, the vibrating plate 36, the plurality of piezoelectric elements 38, the housing 42, and the sealing body 44 are disposed at a surface on the negative side in the Z direction of the channel substrate 32. In contrast, the nozzle plate 46 and the vibration absorber 48 are disposed at a surface on the positive side in the Z direction of the channel substrate 32. The elements of the liquid ejecting head 26 each are a plate-shaped member long in the Y direction generally similarly to the channel substrate 32, and are bonded to one another by using, for example, an adhesive.

As illustrated in FIG. 2, the nozzle plate 46 is a plate-shaped member in which a plurality of nozzles N arranged in the Y direction are formed. Each nozzle N is a through hole through which the reactive ink passes. The channel substrate 32, the pressure chamber substrate 34, and the nozzle plate 46 are formed by processing, for example, a single crystal substrate of silicon (Si) by a semiconductor manufacturing technique such as etching. However, the materials and manufacturing methods of the elements of the liquid ejecting head 26 are desirably determined.

The channel substrate 32 is a plate-shaped member for forming a channel of the reactive ink. As illustrated in FIGS. 2 and 3, an opening 322, a first channel 324, and a second channel 326 are formed in the channel substrate 32. The opening 322 is a through hole formed in a long shape along the Y direction in plan view from the Z direction so as to be continuous over the plurality of nozzles N. In contrast, the first channel 324 and the second channel 326 are through holes formed individually for each of the nozzles N. As illustrated in FIG. 3, a relay channel 328 is formed over a plurality of the first channels 324 in the surface on the positive side in the Z direction of the channel substrate 32. The relay channel 328 is a channel for causing the opening 322 to communicate with the plurality of first channels 324.

The housing 42 is a structure manufactured by, for example, injection molding using a resin material, and is fixed to the surface on the negative side in the Z direction of the channel substrate 32. As illustrated in FIG. 3, a housing portion 422 and an inlet 424 are formed in the housing 42. The housing portion 422 is a recessed portion having an outer shape corresponding to the opening 322 of the channel substrate 32, and the inlet 424 is a through hole communicating with the housing portion 422. As understood from FIG. 3, the space in which the opening 322 of the channel substrate 32 and the housing portion 422 of the housing 42 communicate with each other functions as a liquid storage chamber R. The reactive ink supplied from the liquid container 14 and passed through the inlet 424 is stored in the liquid storage chamber R.

The vibration absorber 48 absorbs a pressure fluctuation in the liquid storage chamber R. The vibration absorber 48 of the first embodiment includes an elastic compliance film 481 and a support body 482. The elastic compliance film 481 is an elastically deformable film. As illustrated in FIG. 3, the elastic compliance film 481 is disposed at the surface on the positive side in the Z direction of the channel substrate 32. Specifically, the elastic compliance film 481 closes the opening 322, the relay channel 328, and the plurality of first channels 324 of the channel substrate 32. That is, the bottom surface of the liquid storage chamber R is constituted by the elastic compliance film 481. The support body 482 is a flat plate member formed of a highly rigid material such as stainless steel, and fixes the elastic compliance film 481 to the surface of the channel substrate 32. The elastic compliance film 481 is deformed in accordance with the pressure of the reactive ink in the liquid storage chamber R, so that a pressure fluctuation in the liquid storage chamber R is absorbed.

As illustrated in FIGS. 2 and 3, the pressure chamber substrate 34 is a plate-shaped member in which a plurality of pressure chambers C corresponding to different nozzles N are formed. The plurality of pressure chambers C are arranged along the Y direction. Each pressure chamber C is a long opening extending along the X direction in plan view. The end portion of a pressure chamber C on the positive side in the X direction overlaps a single first channel 324 of the channel substrate 32 in plan view. The end portion of the pressure chamber C on the negative side in the X direction overlaps a single second channel 326 of the channel substrate 32 in plan view. As understood from the above description, the liquid ejecting unit 30 of the first embodiment includes a plurality of sets each including a pressure chamber C and a nozzle N.

The vibrating plate 36 is disposed at a surface of the pressure chamber substrate 34, on the side opposite to the channel substrate 32. The vibrating plate 36 is an elastically deformable plate-shaped member. The vibrating plate 36 is constituted of, for example, a lamination of an elastic film formed of silicon oxide ($SiO_2$) and an insulating film formed of zirconium oxide ($ZrO_2$).

As understood from FIG. 3, the channel substrate 32 and the vibrating plate 36 face each other at a distance from each other inside each pressure chamber C. The pressure chamber C is positioned between the channel substrate 32 and the vibrating plate 36 and is a space for applying a pressure to the reactive ink filled in the pressure chamber C. The reactive ink stored in the liquid storage chamber R is branched from the relay channel 328 to the respective first channels 324, and is supplied and filled simultaneously to the plurality of pressure chambers C.

As understood from the above description, a channel (hereinafter referred to as "supply channel") 60 for supplying the reactive ink to the plurality of pressure chambers C is formed in the liquid ejecting unit 30. The supply channel 60 of the first embodiment is a channel in which the inlet 424, the liquid storage chamber R (the housing portion 422 and the opening 322), the relay channel 328, and the first channels 324 are coupled to one another in that order from the inlet 424 side. The elastic compliance film 481 constitutes a portion of the supply channel 60. Accordingly, the reactive ink stored in the liquid storage chamber R comes into contact with the elastic compliance film 481. Based on the above-described configuration, the inventors of the present application have studied a material of the elastic compliance film 481 which is suitable from the viewpoint of the combination with the reactive ink.

FIG. 4 is a table illustrating the results of evaluation on the occurrence of a failure in the liquid ejecting head 26 in a plurality of cases (A1 to A7) using mutually different combinations of materials of elastic compliance films 481 and types of reactive inks. FIG. 4 illustrates a result of evaluating a period until a failure such as dissolution or peeling-off occurs at the elastic compliance film 481 when the liquid ejecting head 26 is continuously operated.

As understood from FIG. 4, in the configuration (A1) in which the elastic compliance film 481 is formed of a para-aramid resin, there is a tendency that, in comparison with a case where the elastic compliance film 481 is formed of other materials (A2 to A7), the occurrence of a failure such as dissolution or peeling-off is suppressed, regardless of the type of the reactive ink. By taking into account the results of the evaluation described above, the elastic compliance film 481 of the first embodiment is formed of a para-aramid resin.

As illustrated in FIGS. 2 and 3, the plurality of piezoelectric elements 38 corresponding to the different nozzles N are disposed at a surface of the vibrating plate 36 opposite to the pressure chambers C. Each piezoelectric element 38 is an actuator that is deformed when a drive signal is supplied to the piezoelectric element 38, and is formed in a long shape along the X direction in plan view. Specifically, the piezoelectric element 38 changes the capacity of the corresponding pressure chamber C when a drive signal is supplied to the piezoelectric element 38. The plurality of piezoelectric elements 38 are arranged in the Y direction so as to correspond to the plurality of pressure chambers C. When the vibrating plate 36 vibrates in conjunction with the deformation of the piezoelectric element 38, the pressure in the pressure chamber C is changed, and hence the reactive ink filled in the pressure chamber C is ejected through the second channel 326 and the nozzle N. The liquid ejecting head 26 of the first embodiment can eject the reactive ink by 5 pl (picoliters) or less from the nozzle N. However, the ejection amount of the reactive ink is not limited to the above-described example.

The sealing body 44 illustrated in FIGS. 2 and 3 is a structure that protects the plurality of piezoelectric elements 38 and reinforces the mechanical strength of the pressure chamber substrate 34 and the vibrating plate 36. The sealing body 44 is fixed to the surface of the vibrating plate by, for example, an adhesive. The plurality of piezoelectric elements 38 are housed inside a recessed portion formed at a surface of the sealing body 44 facing the vibrating plate 36.

As illustrated in FIG. 3, an end portion of the wiring substrate 50 is bonded to the liquid ejecting unit 30. Specifically, the wiring substrate 50 is bonded to the surface of the vibrating plate 36. As the wiring substrate 50, a flexible wiring substrate 50, such as a flexible printed circuit (FPC) or a flexible flat cable (FFC), may be suitably employed. A drive circuit 52 is mounted at the wiring substrate 50. The drive circuit 52 is an IC chip for controlling the supply of a drive signal to each of the plurality of piezoelectric elements 38. The drive signal output from the drive circuit 52 is supplied to each piezoelectric element 38 from the wiring substrate 50.

Figure 5:
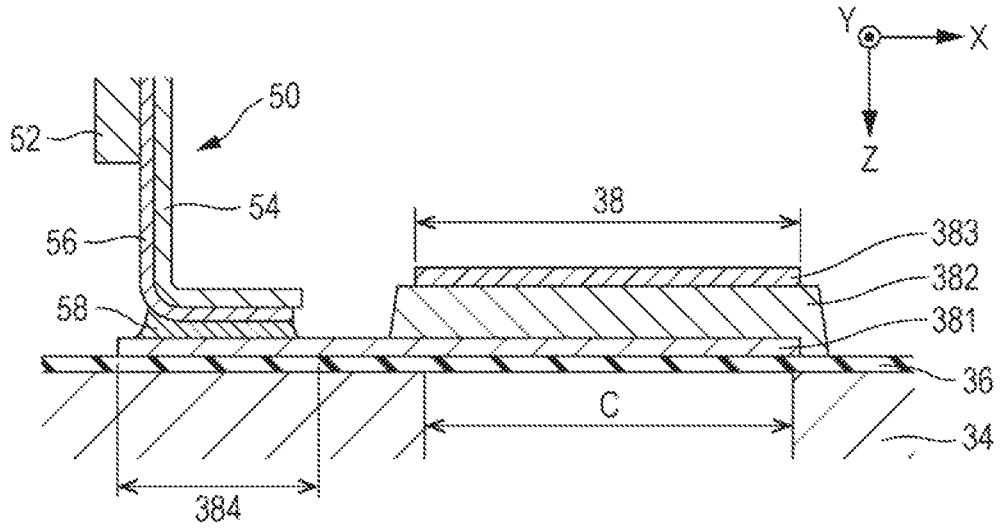
FIG. 5 is a cross-sectional view focusing on a piezoelectric element and a wiring substrate.

FIG. 5 is a cross-sectional view focusing on the piezoelectric element 38 and the wiring substrate 50. As illustrated in FIG. 5, the piezoelectric element 38 is generally constituted of a lamination of a first electrode 381, a piezoelectric layer 382, and a second electrode 383. The first electrode 381 is an individual electrode formed at the surface of the vibrating plate 36 at a distance from another first electrode 381 for each of the piezoelectric elements 38. The first electrode 381 of the first embodiment extends to a region in which the wiring substrate 50 is mounted. An end portion of the first electrode 381 of each piezoelectric element 38 near the wiring substrate 50 functions as a connection terminal 384 of the piezoelectric element 38.

The piezoelectric layer 382 is formed on a surface of the first electrode 381 by using, for example, a ferroelectric piezoelectric material such as lead zirconate titanate (PZT). The second electrode 383 is formed on the surface of the piezoelectric layer 382. The second electrode 383 of the first embodiment is a band-shaped common electrode that is continuous over the plurality of piezoelectric elements 38. A predetermined reference voltage is applied to the second electrode 383.

As illustrated in FIG. 5, the wiring substrate 50 according to the first embodiment includes a base member 54 and a plurality of signal wires 56. The base member 54 is a flexible film formed of a resin material such as polyimide. That is, the wiring substrate 50 is a chip on film (COF) configured such that a drive circuit 52 is mounted on a surface of the base member 54. The signal wires 56 corresponding to the respective piezoelectric elements 38 are formed at the surface of the base member 54. Each signal wire 56 is a conductive pattern for supplying a drive signal output from the drive circuit 52 to the connection terminal 384 of the piezoelectric element 38, and is formed of a low-resistance metal such as copper (Cu).

As illustrated in FIG. 5, each signal wire 56 of the wiring substrate 50 and the connection terminal 384 of corresponding one of the piezoelectric elements 38 are electrically connected to each other by solder 58. The solder 58 of the first embodiment is formed of a Sn—Pb-based alloy, a Sn—Zn-based alloy, a Sn—Cu-based alloy, a Sn—Ag-based alloy, or a Sn—Bi-based alloy. In consideration with environmental influences and the like, lead-free solder is suitable as a material for the solder 58. A portion of the reactive ink ejected from the liquid ejecting unit 30 may float inside the liquid ejecting apparatus 100 as very small atomized liquid droplets (mist). In the first embodiment, since a very small amount of the reactive ink is ejected by 5 pl or less from the nozzle N, the mist electrically charged by the Lenard effect is generated, and the mist likely adheres particularly to the signal wire 56 or the connection terminal 384. In view of the above-described circumstances, the solder 58 is desirably formed of a material that is less decreased in reliability even in a humid environment. Specifically, a Sn—Cu-based alloy, a Sn—Ag-based alloy, or a Sn—Bi-based alloy is particularly suitable as a material for the solder 58.

In a configuration (hereinafter referred to as "comparative example") in which the signal wire 56 and the connection terminal 384 are electrically connected to each other by a conductive adhesive, the adhesive is dissolved or deteriorated due to the adhesion of the mist of the reactive ink. Therefore, a failure, such as peeling-off of the wiring substrate 50 or defective connection of the signal wire 56, may occur. In contrast to the comparative example, in the first embodiment, the signal wire 56 of the wiring substrate and the connection terminal 384 of the piezoelectric element 38 are electrically connected to each other by the solder 58. The solder 58 is hardly melted or deteriorated even when the mist of the reactive ink adheres to the solder 58. Therefore, according to the first embodiment, there is an advantage that it is possible to suppress a failure due to the adhesion of the reactive ink, such as peeling-off of the wiring substrate 50 or defective connection of the signal wire 56.

FIG. 6 is a table illustrating the results of evaluation on the occurrence of a failure in the liquid ejecting head 26 in each of a plurality of cases (B1 to B6) using mutually different combinations of materials for electrically connecting a signal wire 56 and a connection terminal 384 to each other, and types of reactive inks. The configuration B1 and the configuration B2 of FIG. 6 are configured such that a conductive adhesive is used for connection between the signal wire 56 and the connection terminal 384. The configuration B1 is a configuration using a conductive adhesive (Model No.: TB3303G) manufactured by ThreeBond Co., Ltd., and the configuration B2 is a configuration using a conductive adhesive (Model No.: SX-ECA48) manufactured by Cemedine Co., Ltd. In contrast, the configuration B3 to the configuration B6 are configurations in which the solder 58 is used for connection between the signal wire 56 and the connection terminal 384.

As understood from FIG. 6, in the configuration (B1, B2) in which a conductive adhesive is used for connection between the signal wire 56 and the connection terminal 384, there is a high possibility that a failure may occur within about one year. In contrast, in the configuration (B3 to B6) of the first embodiment using the solder 58 for connection between the signal wire 56 and the connection terminal 384, even when the liquid ejecting head 26 is continuously operated for one year or more, almost no failure occurs. As understood from the above-described results, according to the first embodiment, there is an advantage that a failure due to the reactive ink can be suppressed for the connection between the signal wire 56 and the connection terminal 384.

As described above, according to the first embodiment, the elastic compliance film 481 is formed of a para-aramid resin. Therefore, for example, as compared with a configuration in which the elastic compliance film 481 is formed of polyphenylene sulfide (PPS) or the like, it is possible to suppress a failure such as dissolution or peeling-off of the elastic compliance film 481 due to the adhesion of the reactive ink. Further, the signal wire 56 and the connection terminal 384 are electrically connected to each other by the solder 58. Accordingly, as compared with a configuration in which the signal wire 56 and the connection terminal 384 are connected by a conductive adhesive, it is possible to suppress a failure such as peeling-off of the wiring substrate 50 due to the adhesion of the reactive ink.

Second Embodiment

A second embodiment of the present disclosure is described. Note that, for the elements in the following examples having functions similar to those in the first embodiment, the reference numerals used in the description of the first embodiment are used and the detailed description thereof is omitted.

Figure 7:
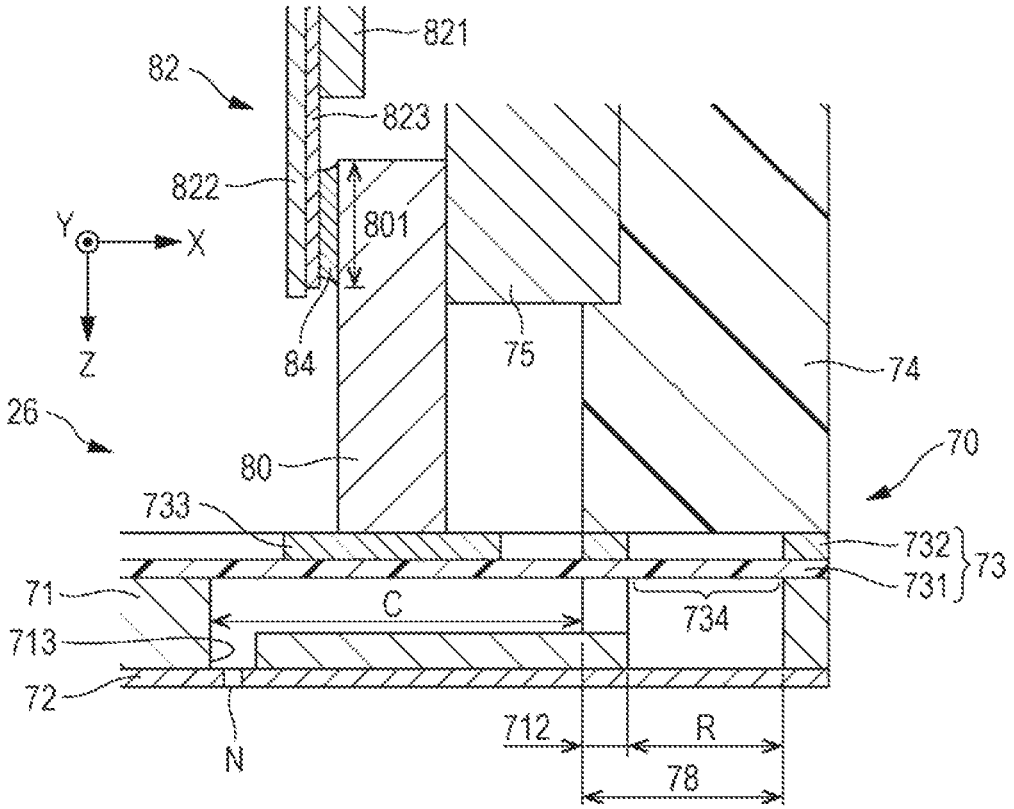
FIG. 7 is a cross-sectional view focusing on a piezoelectric element and a wiring substrate according to a second embodiment.

FIG. 7 is a cross-sectional view of the liquid ejecting head 26 according to the second embodiment. As illustrated in FIG. 7, the liquid ejecting head 26 according to the second embodiment includes a liquid ejecting unit 70, a piezoelectric element 80, and a wiring substrate 82.

The liquid ejecting unit 70 includes a channel substrate 71, a nozzle plate 72, a vibrating plate 73, a housing 74, and a fixed plate 75. The nozzle plate 72 is bonded to a surface on the positive side in the Z direction of the channel substrate 71, and the vibrating plate 73 is bonded to a surface on the negative side in the Z direction of the channel substrate 71. A plurality of nozzles N arranged in the Y direction are formed in the nozzle plate 72.

A liquid storage chamber R, a first channel 712, a pressure chamber C, and a second channel 713 are formed in the channel substrate 71. The liquid storage chamber R is a common liquid chamber that is continuous over the plurality of nozzles N. The first channel 712, the second channel 713, and the pressure chamber C are formed for each nozzle N. The first channel 712 is a contraction channel that causes the pressure chamber C to communicate with the liquid storage chamber R. The liquid storage chamber R and the first channel 712 function as a supply channel 78 through which the reactive ink is supplied to the pressure chamber C. The second channel 713 causes the pressure chamber C to communicate with the nozzle N.

The vibrating plate 73 includes an elastic film 731 and a support plate 732. The elastic film 731 is bonded to the surface of the channel substrate 71, and the support plate 732 is stacked on the elastic film 731. The elastic film 731 is formed of, for example, a para-aramid resin, and the support plate 732 is formed of, for example, stainless steel. The support plate 732 is partially removed to form an island portion 733 that overlaps the pressure chamber C. The region of the vibrating plate 73 overlapping the liquid storage chamber R is formed of a single layer of the elastic film 731 by the removal of the support plate 732, and functions as an elastic compliance film 734. Therefore, in the second embodiment as well, similarly to the first embodiment, the elastic compliance film 734 is formed of a para-aramid resin. Similarly to the first embodiment, the elastic compliance film 734 constitutes a portion of the supply channel 78, and absorbs a pressure fluctuation in the liquid storage chamber R. Specifically, the elastic compliance film 734 constitutes the upper surface of the liquid storage chamber R.

The housing 74 is bonded to a surface of the vibrating plate 73 opposite to the channel substrate 71, and the fixed plate 75 is fixed to the housing 74. The piezoelectric element 80 is a length-extension vibration driving element in which a piezoelectric layer and an electrode layer are alternately stacked, and a tip portion thereof is in contact with the island portion 733. When the island portion 733 vibrates together with the elastic film 731 in conjunction with the deformation of the piezoelectric element 80, the reactive ink filled in the pressure chamber C is ejected through the second channel 713 and the nozzle N. Similarly to the first embodiment, the liquid ejecting head 26 according to the second embodiment can eject the reactive ink by 5 pl (picoliters) or less from the nozzle N. However, the ejection amount of the reactive ink is not limited to the above-described example. A connection terminal 801 is formed at a side surface of the piezoelectric element 80.

Similarly to the first embodiment, the wiring substrate 82 includes a base member 822 at which a drive circuit 821 is mounted, and a plurality of signal wires 823. Each of the signal wires 823 of the wiring substrate 82 and the connection terminal 801 of corresponding one of the piezoelectric elements 80 are electrically connected to each other by solder 84. That is, in the first embodiment, the signal wire 56 is connected to the connection terminal 384 formed at the liquid ejecting unit 30. In contrast, in the second embodiment, the signal wire 823 is connected to the connection terminal 801 formed at the piezoelectric element 80.

Similarly to the first embodiment, the solder 84 is formed of a Sn—Pb-based alloy, a Sn—Zn-based alloy, a Sn—Cu-based alloy, a Sn—Ag-based alloy, or a Sn—Bi-based alloy. In a further desirable embodiment, lead-free solder such as a Sn—Cu-based alloy, a Sn—Ag-based alloy, or a Sn—Bi-based alloy is employed as a material for the solder 84. As described above, the elastic compliance film 734 according to the second embodiment is formed of a para-aramid resin, similarly to the first embodiment. Therefore, also in the second embodiment, advantageous effects similar to those of the first embodiment can be attained.

Modifications

The embodiments described above may be modified in various ways. Specific modifications which can be applied to the above-described embodiments are exemplified below. Two or more embodiments desirably selected from the following examples may be appropriately combined within a range in which the selected embodiments do not conflict with one another.

(1) In the first embodiment, the configuration in which the first electrode 381 is an individual electrode and the second electrode 383 is a common electrode is exemplified; however, the first electrode 381 may be a common electrode that continues over the plurality of piezoelectric elements 38, and the second electrode 383 may be a separate individual electrode for each piezoelectric element 38. Further, both of the first electrode 381 and the second electrode 383 may serve as individual electrodes.

(2) In the above-described embodiments, the serial liquid ejecting apparatus 100 in which the transport body 242 at which the liquid ejecting head 26 is mounted reciprocates is exemplified; however, the present disclosure can also be applied to a line liquid ejecting apparatus in which a plurality of nozzles N are distributed over the entire width of a medium 12.

(3) The liquid ejecting apparatus 100 exemplified in each of the above-described embodiments may be employed in various apparatuses such as facsimile apparatuses and copying machines in addition to apparatuses dedicated to printing. Note that the use of the liquid ejecting apparatus of the present disclosure is not limited to printing. For example, a liquid ejecting apparatus that ejects a solution of a coloring material is used as a manufacturing apparatus that forms a color filter of a liquid crystal display device. Moreover, a liquid ejecting apparatus that ejects a solution of a conductive material is used as a manufacturing apparatus that forms wires or electrodes of a wiring substrate.

What is claimed is:

1. A liquid ejecting apparatus comprising:

a liquid ejecting unit including a pressure chamber substrate defining at least one pressure chamber filled with a reactive ink, a channel substrate attached to the pressure chamber substrate and defining a supply channel through which the reactive ink is supplied to the pressure chamber, and at least one nozzle communicating with the pressure chamber, wherein the channel substrate includes an aperture formed therein that is closed by an elastic compliance film that forms a portion of the supply channel and elastically deforms to absorb pressure fluctuations in the supply channel;

a piezoelectric element that changes a capacity of the pressure chamber when an electric signal is supplied to the piezoelectric element; and a flexible wiring substrate at which a signal wire for supplying the electric signal to a connection terminal of the piezoelectric element is formed, wherein the elastic compliance film is formed of a para-aramid resin, and the connection terminal and the signal wire are electrically connected to each other by solder.

2. The liquid ejecting apparatus according to claim 1, wherein the at least one pressure chamber includes a plurality of pressure chambers filled with reactive inks, the at least one nozzle includes a plurality of nozzles communicating with the pressure chambers, and the liquid ejecting unit includes a plurality of sets each including the nozzle and the pressure chamber, the supply channel includes a liquid storage chamber communicating with the plurality of pressure chambers, and the elastic compliance film forms a portion of the liquid storage chamber.

3. The liquid ejecting apparatus according to claim 1, wherein the nozzle ejects the reactive ink by 5 pl or less.

4. The liquid ejecting apparatus according to claim 1, wherein the solder is Sn—Cu-based lead-free solder, Sn—Ag-based lead-free solder, or Sn—Bi-based lead-free solder.

5. A liquid ejecting head comprising:

a liquid ejecting unit including a pressure chamber substrate defining at least one pressure chamber filled with a reactive ink, a channel substrate attached to the pressure chamber substrate and defining a supply channel through which the reactive ink is supplied to the pressure chamber, and at least one nozzle communicating with the pressure chamber, wherein the channel substrate includes an aperture formed therein that is closed by an elastic compliance film that forms a portion of the supply channel and elastically deforms to absorb pressure fluctuations in the supply channel;

a piezoelectric element that changes a capacity of the pressure chamber when an electric signal is supplied to the piezoelectric element; and a flexible wiring substrate at which a signal wire for supplying the electric signal to a connection terminal of the piezoelectric element is formed, wherein the elastic compliance film is formed of a para-aramid resin, and the connection terminal and the signal wire are electrically connected to each other by solder.

6. The liquid ejecting head according to claim 5, wherein the at least one pressure chamber includes a plurality of pressure chambers filled with reactive inks, the at least one nozzle includes a plurality of nozzles communicating with the pressure chambers, and the liquid ejecting unit includes a plurality of sets each including the nozzle and the pressure chamber, the supply channel includes a liquid storage chamber communicating with the plurality of pressure chambers, and the elastic compliance film forms a portion of the liquid storage chamber.

7. The liquid ejecting head according to claim 5, wherein the nozzle ejects the reactive ink by 5 pl or less.

8. The liquid ejecting head according to claim 5, wherein the solder is Sn—Cu-based lead-free solder, Sn—Ag-based lead-free solder, or Sn—Bi-based lead-free solder.

9. A liquid ejecting head comprising:

a channel substrate defining at least one pressure chamber filled with a reactive ink and a supply channel through which the reactive ink is supplied to the pressure chamber, wherein the channel substrate includes an aperture formed therein that is closed by an elastic compliance film that forms a portion of the supply channel and elastically deforms to absorb pressure fluctuations in the supply channel;

at least one nozzle communicating with the pressure chamber;

a piezoelectric element that changes a capacity of the pressure chamber when an electric signal is supplied to the piezoelectric element; and a flexible wiring substrate at which a signal wire for supplying the electric signal to a connection terminal of the piezoelectric element is formed, wherein the elastic compliance film is formed of a para-aramid resin, and the connection terminal and the signal wire are electrically connected to each other by solder.

10. The liquid ejecting head according to claim 9, wherein the at least one pressure chamber includes a plurality of pressure chambers filled with reactive inks, the at least one nozzle includes a plurality of nozzles communicating with the pressure chambers, and the liquid ejecting unit includes a plurality of sets each including the nozzle and the pressure chamber, the supply channel includes a liquid storage chamber communicating with the plurality of pressure chambers, and the elastic compliance film forms a portion of the liquid storage chamber.

11. The liquid ejecting head according to claim 9, wherein the nozzle ejects the reactive ink by 5 pl or less.

12. The liquid ejecting head according to claim 9, wherein the solder is Sn—Cu-based lead-free solder, Sn—Ag-based lead-free solder, or Sn—Bi-based lead-free solder.

13. A liquid ejecting apparatus comprising the liquid ejecting head according to claim 9.

* * * * *